US007004212B2

(12) United States Patent
Gill et al.

(10) Patent No.: US 7,004,212 B2
(45) Date of Patent: Feb. 28, 2006

(54) MOVEABLE HEAD BULK BAG FILLER

(75) Inventors: David R. Gill, Stewartsville, NJ (US); Keith W. Sterner, Bethlehem, PA (US); John F. Simonoff, Jr., Easton, PA (US)

(73) Assignee: Flexicon Corporation, Bethlehem, PA (US)

( * ) Notice: Subject to any disclaimer, the term of this patent is extended or adjusted under 35 U.S.C. 154(b) by 0 days.

(21) Appl. No.: 11/098,277

(22) Filed: Apr. 4, 2005

(65) Prior Publication Data

US 2005/0217754 A1 Oct. 6, 2005

Related U.S. Application Data

(60) Provisional application No. 60/559,085, filed on Apr. 2, 2004.

(51) Int. Cl.
*B65B 1/04* (2006.01)

(52) U.S. Cl. ..... 141/316; 141/10; 141/83; 141/166; 141/314

(58) Field of Classification Search ..... 141/10, 141/68, 83, 114, 163–176, 313–316; 53/468–473
See application file for complete search history.

(56) References Cited

U.S. PATENT DOCUMENTS

| | | | | |
|---|---|---|---|---|
| 1,909,670 | A | 5/1933 | Evans | |
| 2,950,589 | A | 8/1960 | Litchard | |
| 3,225,514 | A | 12/1965 | Inglett | |
| 3,225,515 | A | 12/1965 | Inglett | |
| 3,945,173 | A | 3/1976 | Buzzi | |
| 4,078,358 | A | 3/1978 | Henderson | |
| 4,182,094 | A | 1/1980 | Lieder et al. | |
| 4,211,053 | A | 7/1980 | Niccolls | |
| 4,305,241 | A | 12/1981 | Tetenborg et al. | |
| 5,036,893 | A | 8/1991 | DeCrane | |
| 5,056,571 | A | 10/1991 | Derby | |
| 5,165,455 | A | 11/1992 | DeCrane | |
| 5,222,535 | A | 6/1993 | Roders | |
| 5,337,541 | A | 8/1994 | Gmuer | |
| 5,400,837 | A * | 3/1995 | Kelley et al. | 141/10 |
| 5,787,945 | A | 8/1998 | Riemersma | |
| 6,065,271 | A | 5/2000 | Nicastro | |
| 6,374,874 | B1 | 4/2002 | Payne | |
| 6,564,534 | B1 | 5/2003 | Poulton et al. | |
| 6,651,407 | B1 | 11/2003 | Hiramoto et al. | |
| 6,776,197 | B1 * | 8/2004 | DeCrane | 141/10 |
| 2003/0217528 | A1 | 11/2003 | Wilson | |

OTHER PUBLICATIONS

Material Transfer and Storage Produce Brochure, undated.

* cited by examiner

*Primary Examiner*—Timothy L. Maust
(74) *Attorney, Agent, or Firm*—Volpe and Koenig, P.C.

(57) ABSTRACT

A bulk bag filler for filling bulk bags having bag hanging loops and a fill spout is provided. The filler includes a bag filling head having at least a moveable portion that can be moved from a filling position, in which the hanging loops are suspended from hanging loop supports in a position to allow the bulk bag to be filled, to a bag attaching position, in which at least some of the hanging loop supports for attachment of a bulk bag to be filled and a bag spout connection are positioned in proximity to a side of the bag filler. A method for loading a bulk bag is also provided.

21 Claims, 16 Drawing Sheets

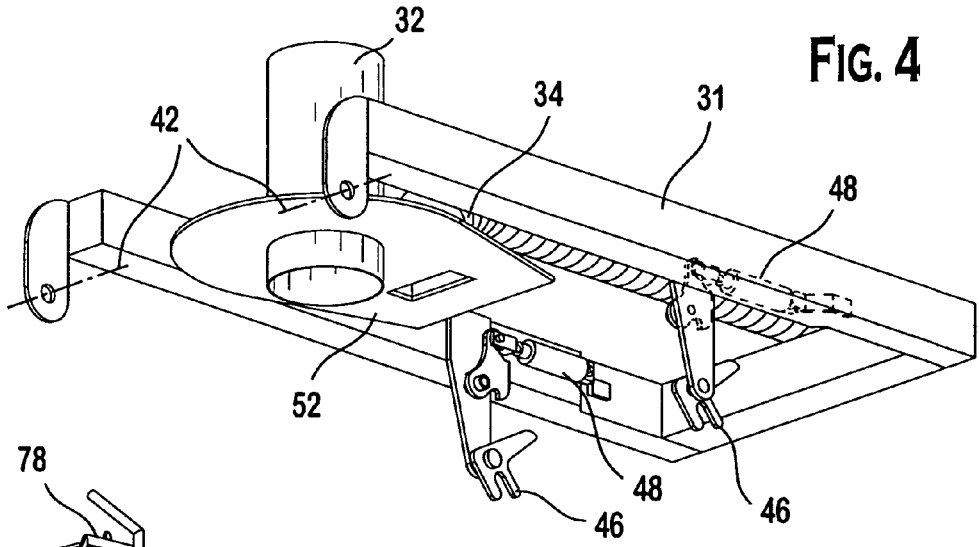
FIG. 4
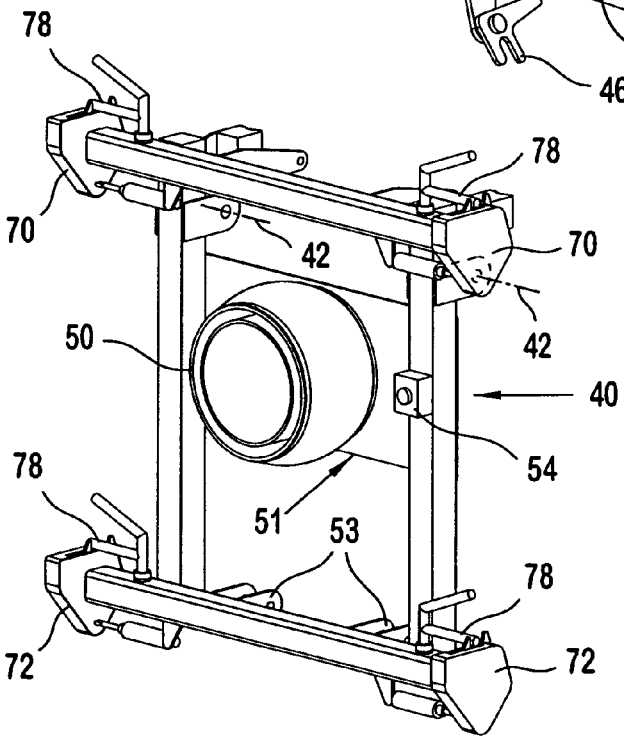
FIG. 5
FIG. 6
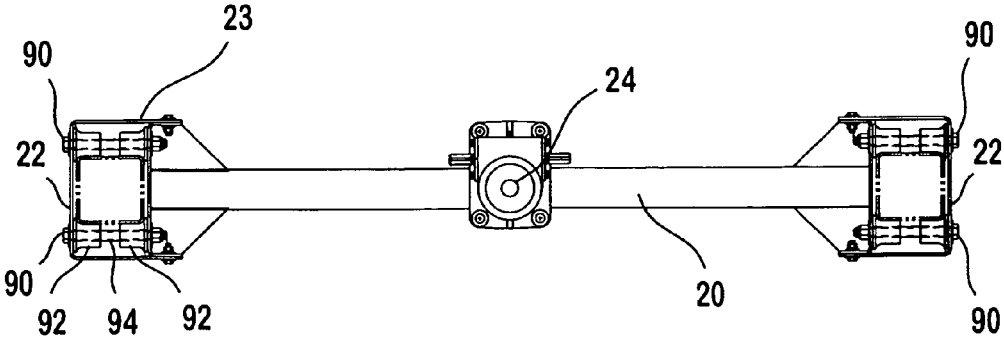

FIG. 7A
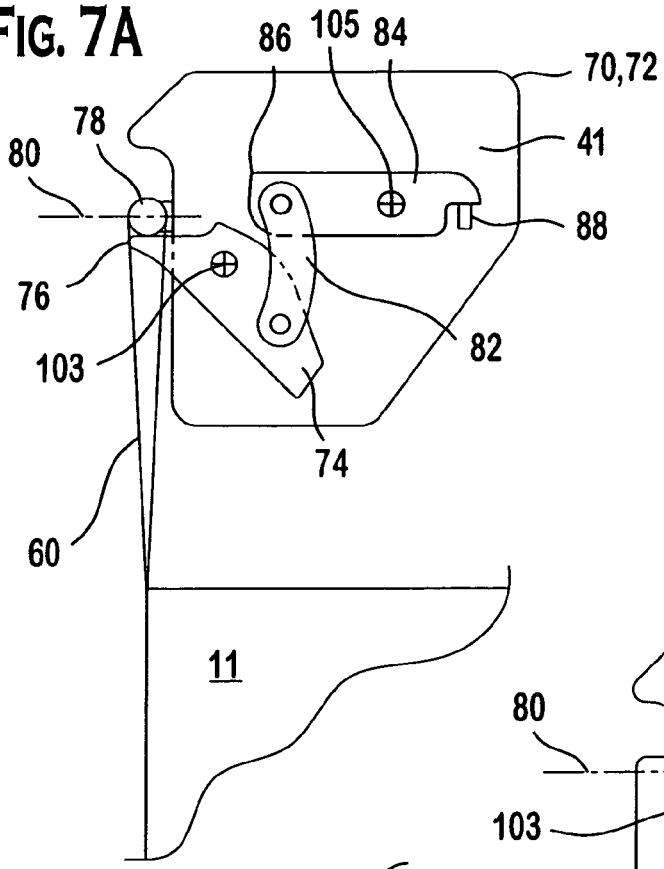
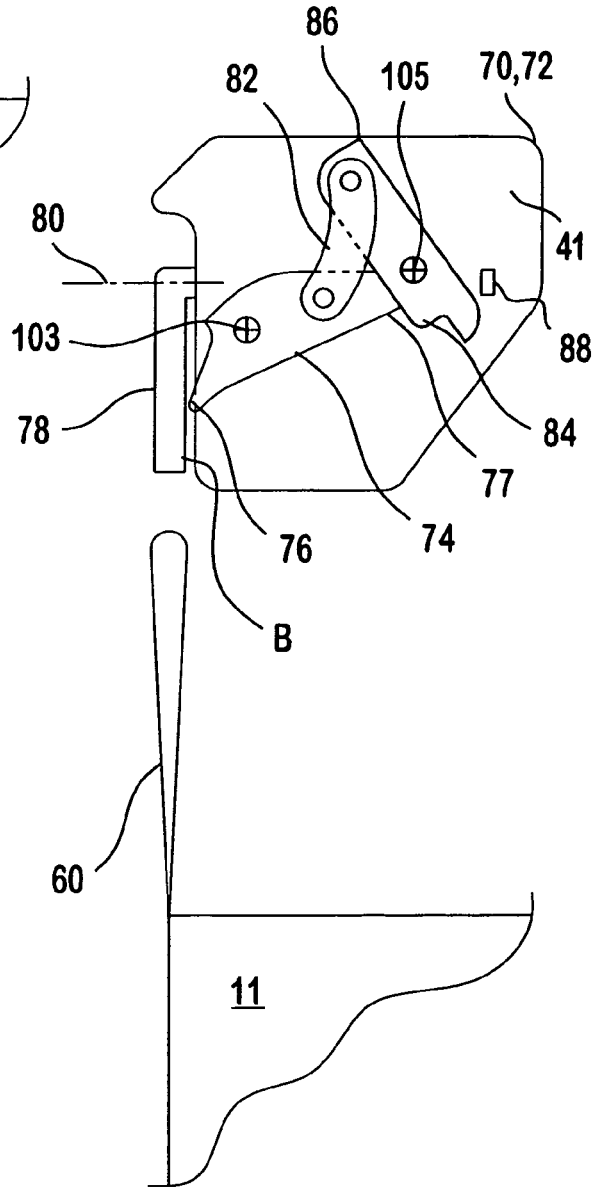
FIG. 7B

FIG. 7C
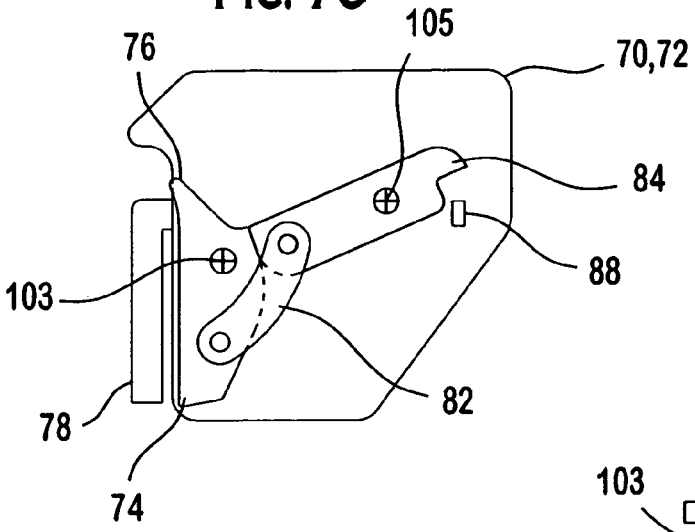
FIG. 7D
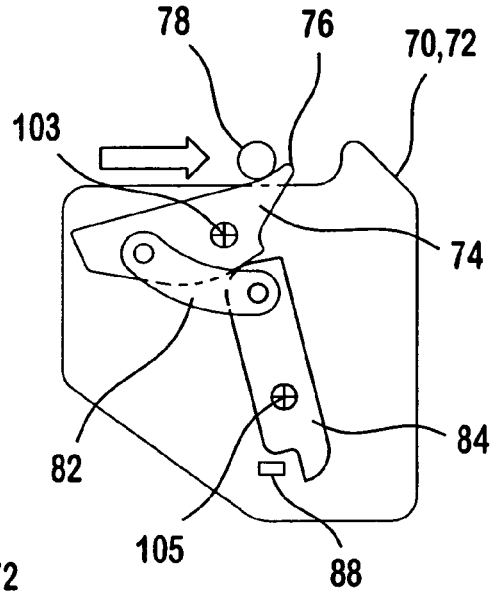
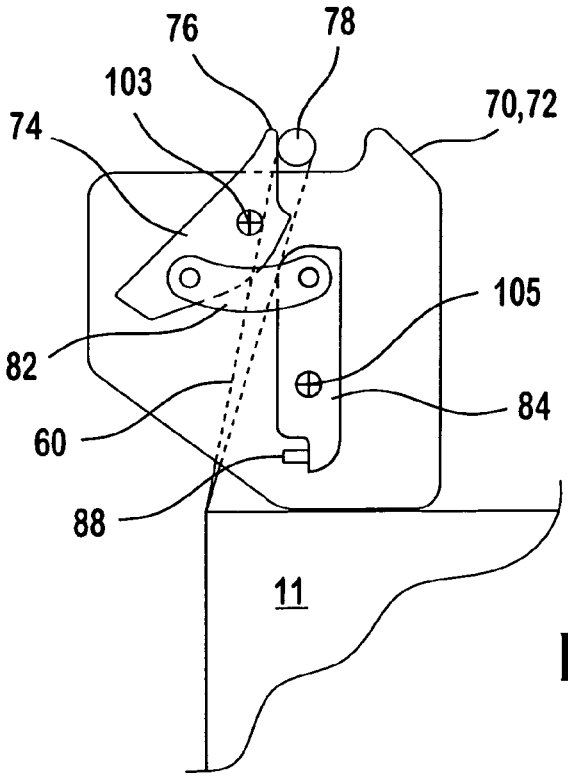
FIG. 7E

MOVEABLE HEAD BULK BAG FILLER

CROSS-REFERENCE TO RELATED APPLICATIONS

This application claims the benefit of U.S. Provisional Application No. 60/559,085, filed Apr. 2, 2004, which is incorporated by reference as if fully set forth.

BACKGROUND

The present invention relates to filling equipment for loading powdered or granular material into bulk bags. More particularly, the present invention relates to a bulk bag filler that allows easy access for an operator to load a new bulk bag to be filled and which allows for easier release and removal of a filled bulk bag.

Known bulk bag (flexible intermediate bulk containers or FIBCs) fillers require an operator to connect the bag filling spout to a generally downwardly directed fill tube and to hook a hanging loop located on each corner of the bulk bag onto an arm or holder on the support structure. This forces the operator to reach upwardly and inwardly into the underside of the filling equipment to hook the bag in position, which is generally awkward and time consuming. Reaching the two rear hanging loops can be extremely awkward and difficult, depending on the size of the bag, the operator's stature and reach, and possibly requiring climbing over obstacles and/or equipment.

One prior known bag filler attempted to address this problem by having a bag holding frame that was rotatable about a vertical axis in order to allow more convenient access to the bag strap holders. However, this requires the centrally located bag filling tube to include a rotatable connection that can be subject to leakage or jamming. Additionally, the operator must still reach the center fill tube in its central location and hold the bag fill spout on the central fill tube prior to the inflatable seal or other holding means being actuated.

It would be desirable to provide a bulk bag filler that is safer, easier and faster to operate, with less likelihood of operator injury.

SUMMARY

Briefly stated, the present invention provides a bulk bag filler having a bag filling head having at least a portion that can be moved from a filling position, in which the bulk bag hanging loops are suspended from hanging loop supports in a position to allow the bulk bag to be filled, to a bag attaching position, in which at least some of the hanging loop supports and the bag spout connection are moved to an operator access position in which the operator can easily reach each the hanging loop supports to attach a bulk bag to be filled. Preferably, the bag filling head has a portion which is repositionable from a filling position, to a bag attaching position in which all of the hanging loop supports are located in an operator access position.

In another aspect of the invention, the hanging loop supports comprise latching mechanisms that provide positive support for the hanging loops in the bag filling position, and can be remotely released to allow a filled bulk bag to be removed. Additionally, the latching mechanisms automatically move the latch to a reset position as the bag filling head moves from the bag filling position to the bag attaching position.

In another aspect, the invention provides a bag filling head that can be moved vertically to accommodate different size bulk bags and to accommodate different operator positions. Additionally, the height of the bag filling head can be adjusted to an easily accessible height for loading a new bulk bag. This is preferably done in conjunction with the movement of the movable portion of the filling head to a bag attaching position. Additionally, the bag filling head can be moved upwardly as the latching mechanisms are released in order to allow a filled bag to be removed from the bulk bag filler prior to attachment of the next bag to be filled.

BRIEF DESCRIPTION OF THE DRAWING(S)

The foregoing summary as well as the following detailed description will be readily understood in conjunction with the appended drawings which illustrate the preferred embodiments of the invention. In the drawings:

FIG. 4 is a perspective view looking up at the underside of the bag fill head assembly after the moveable head portion has been pivoted to the bag attaching position.

FIG. 5 is a perspective view of the moveable head portion of the bag fill head assembly shown in the bag attaching position.

FIG. 6 is a top view taken along lines 6—6 in FIG. 2.

FIGS. 7A–7E are a series of views of a first preferred latching mechanism moving between a latched, horizontal position for bag filling (FIG. 7A), to a released position for removing a filled bag (FIG. 7B), to a reset position prior to the bag filling head repositioning to the bag attaching position (FIG. 7C), to a re-latching position until the bag loop support arm is reset in position with the bag loop of a new bag (FIG. 7D), to the re-latched position (FIG. 7E).

Figure 8:
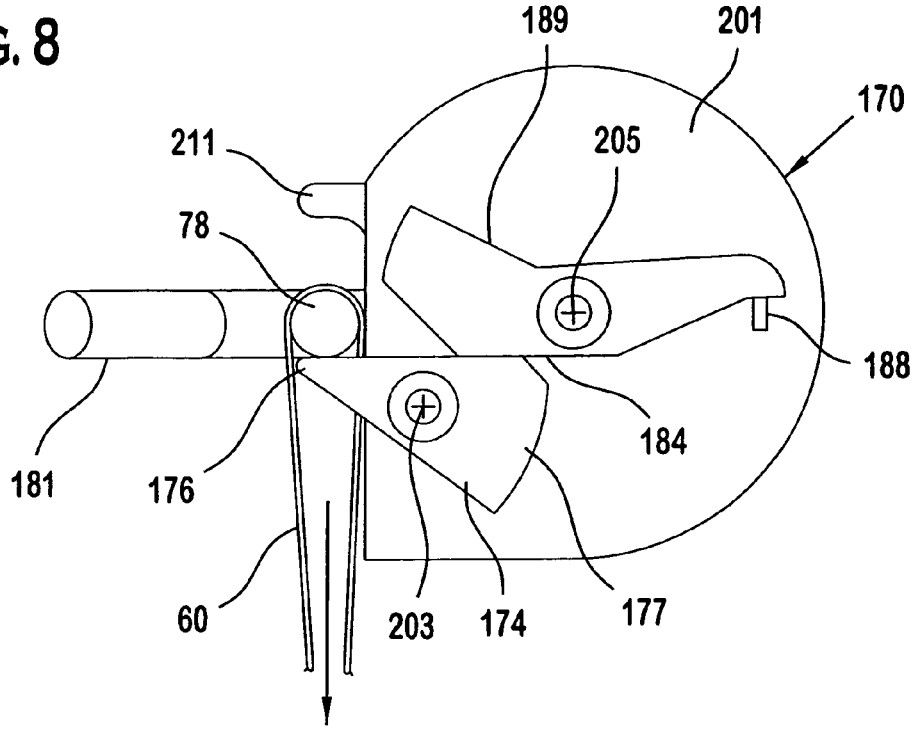

FIG. 8 is a detailed view of a second preferred embodiment of the latching mechanism used in connection with the bulk bag filler of the present invention, shown in a latched position.

Figure 9:
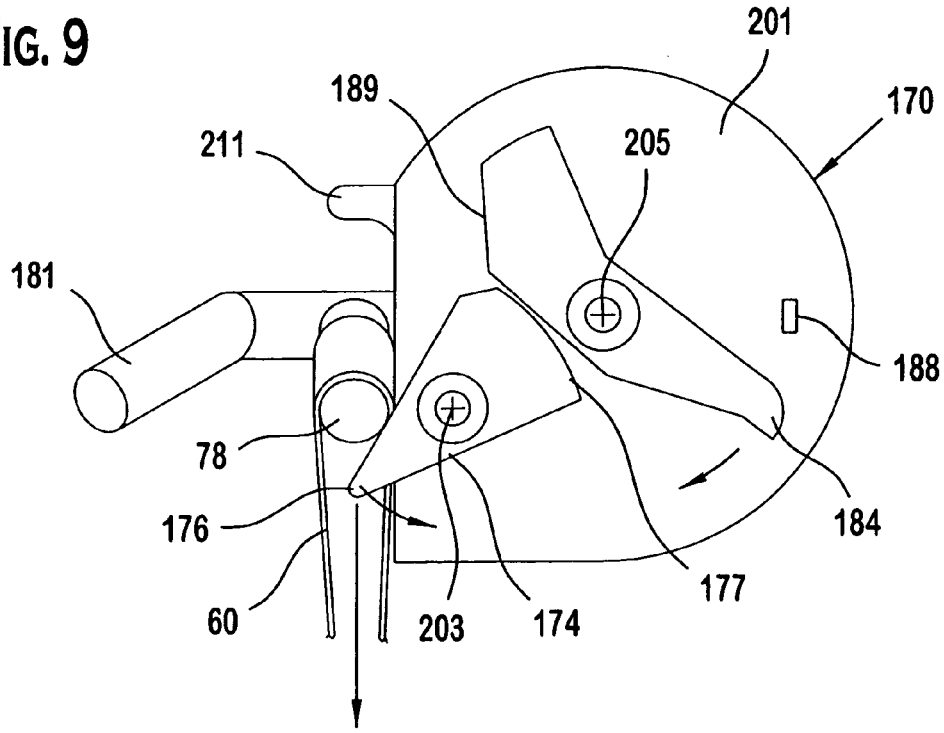

FIG. 9 is a view similar to FIG. 8 showing the latching mechanism after the latch release pin is withdrawn to release the bag straps.

Figure 10:
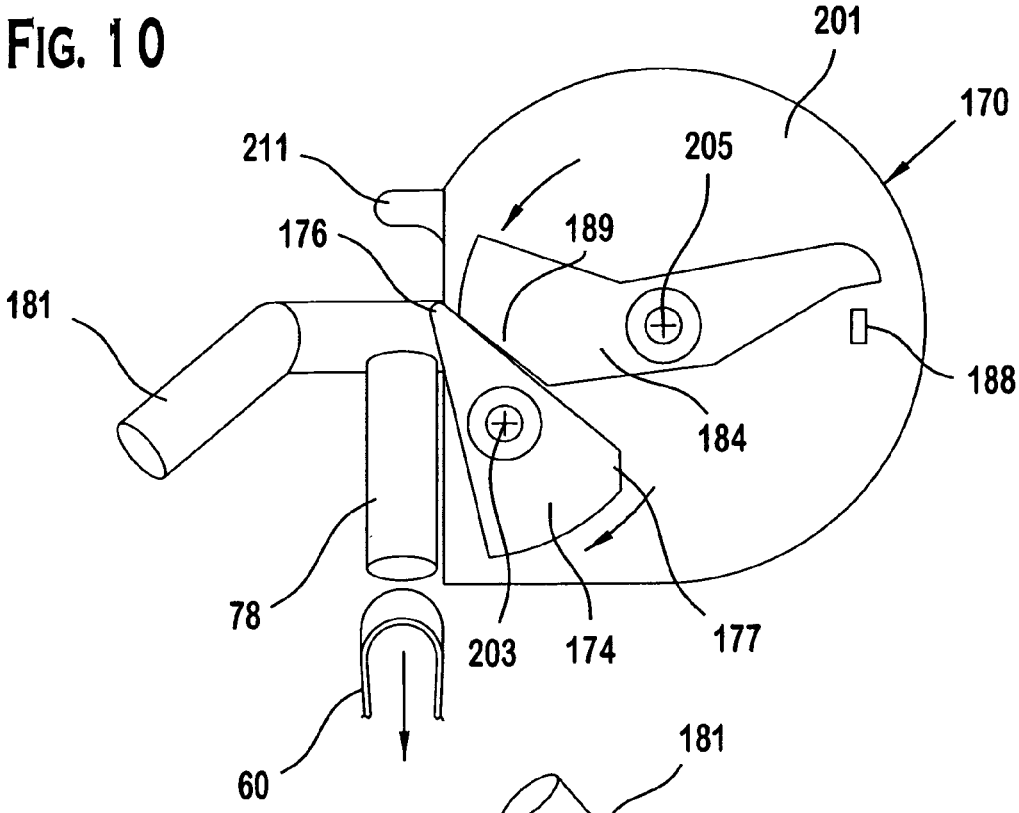

FIG. 10 is a view similar to FIGS. 8 and 9 showing the latch mechanism after the bag strap is released.

Figure 11:
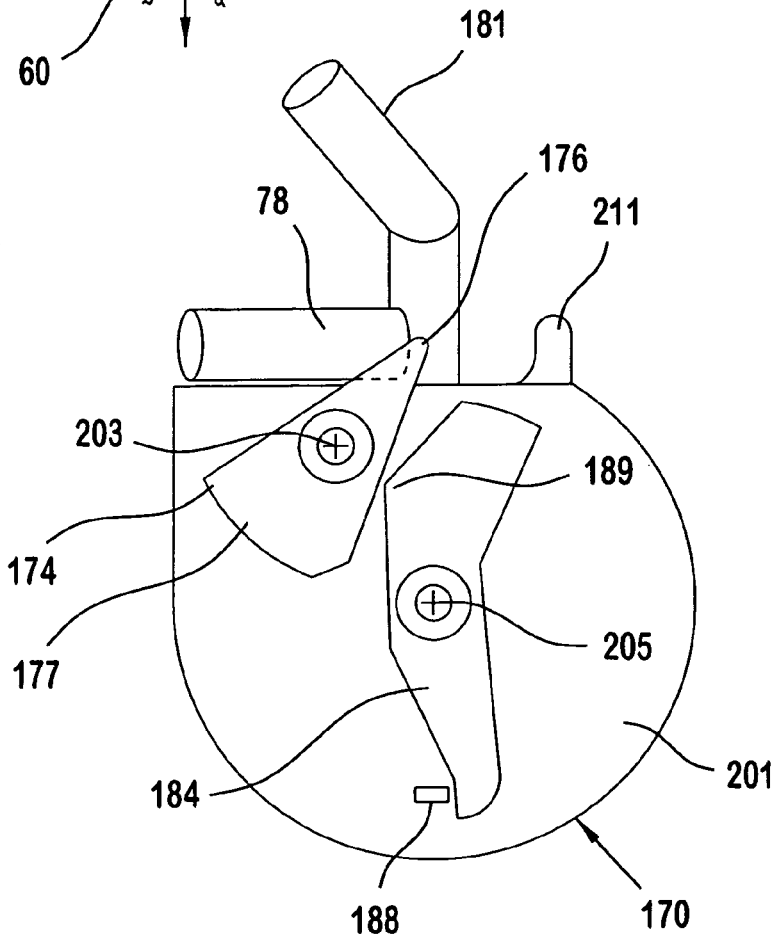

FIG. 11 is a view similar to FIGS. 8–10, showing the latch mechanism after the bag filling head is pivoted to the bag attaching position so that the latch mechanism resets.

Figure 12:
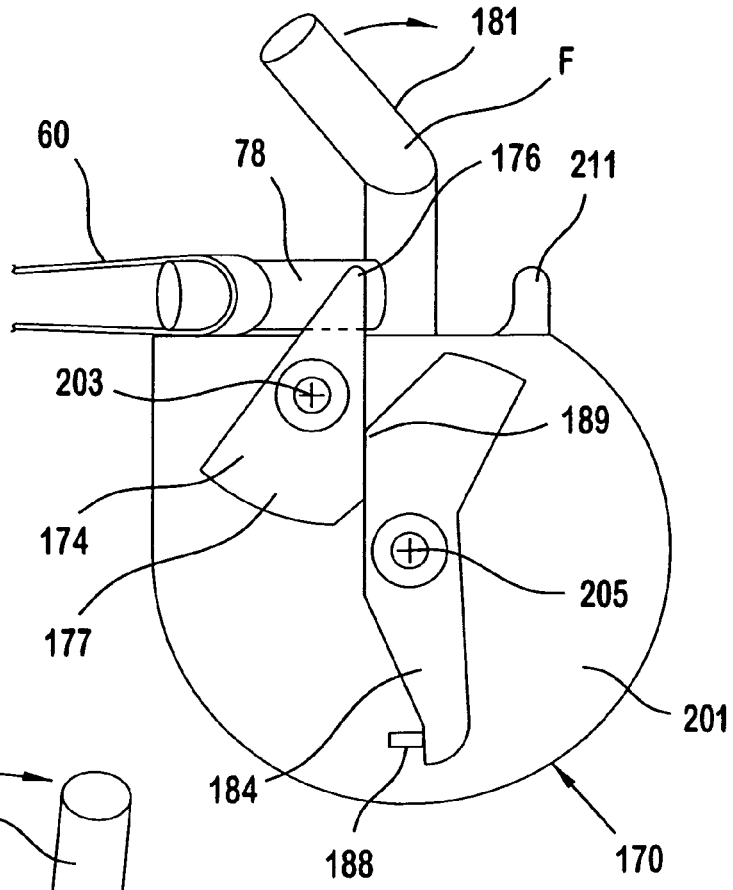

FIG. 12 is a view similar to FIG. 11 showing a bag strap being installed on the support arm.

Figure 13:
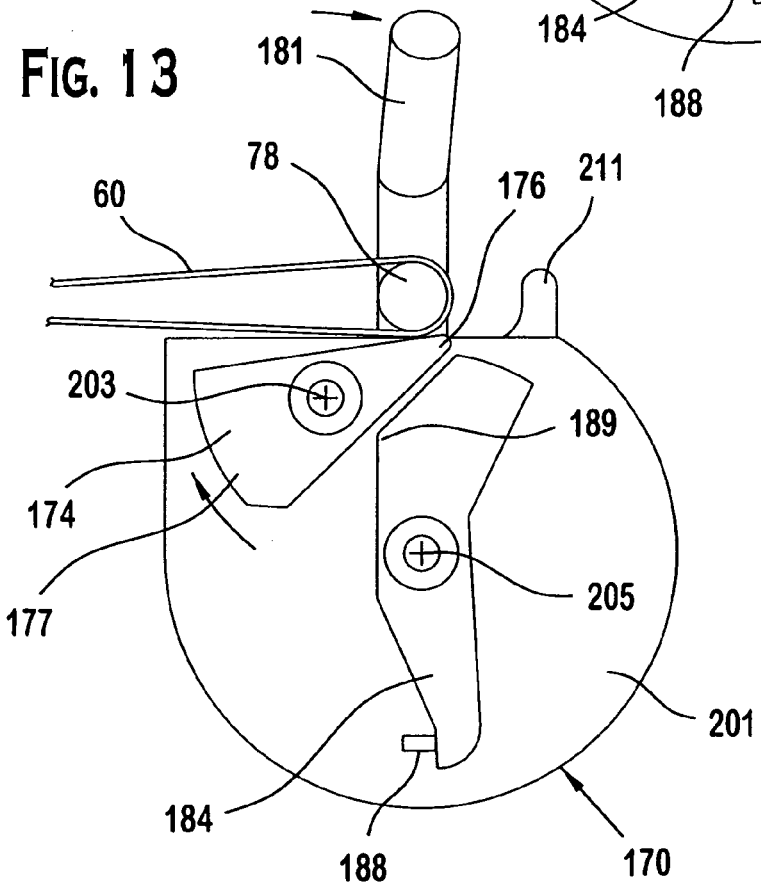

FIG. 13 is a view similar to FIG. 12, showing the support arm being reset to the closed position prior to the bag filling head being returned to the bag filling position.

Figure 14:
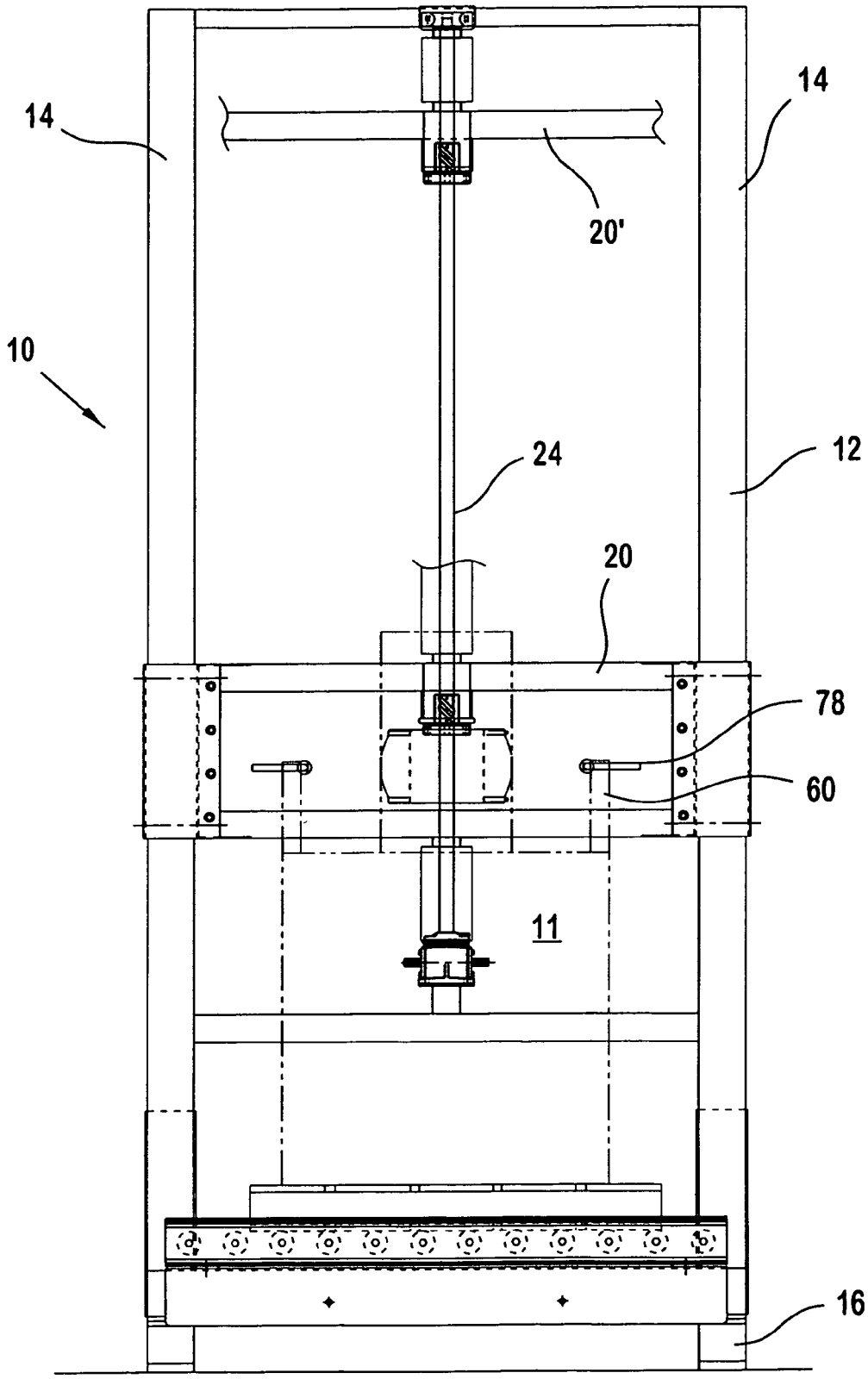

FIG. 14 is a front elevational view showing the bag filling head in a low position for filling a small size bulk bag.

Figure 15:
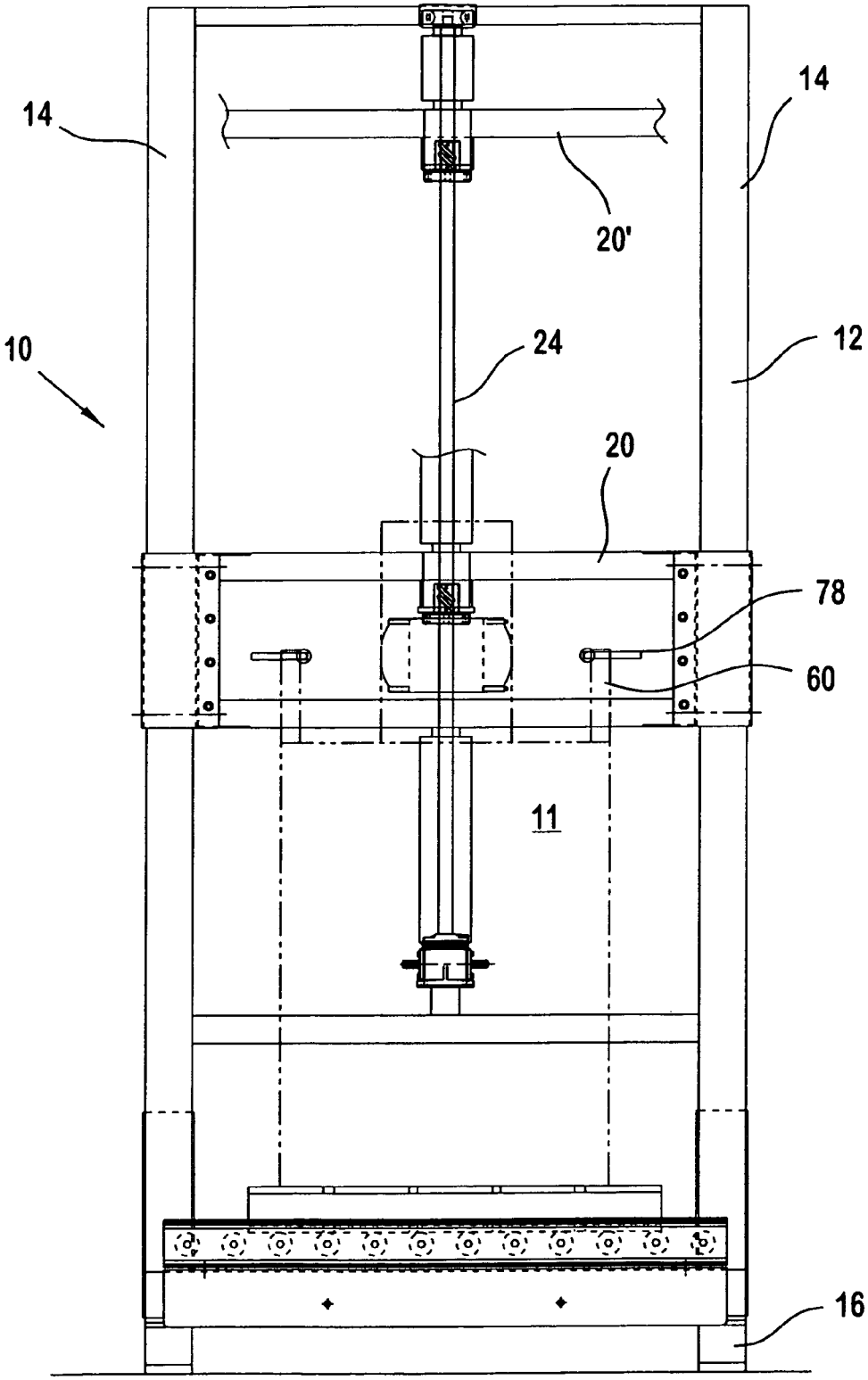

FIG. 15 is a front elevational view showing the bag filling head in an intermediate position for filling a medium size bulk bag.

Figure 16:
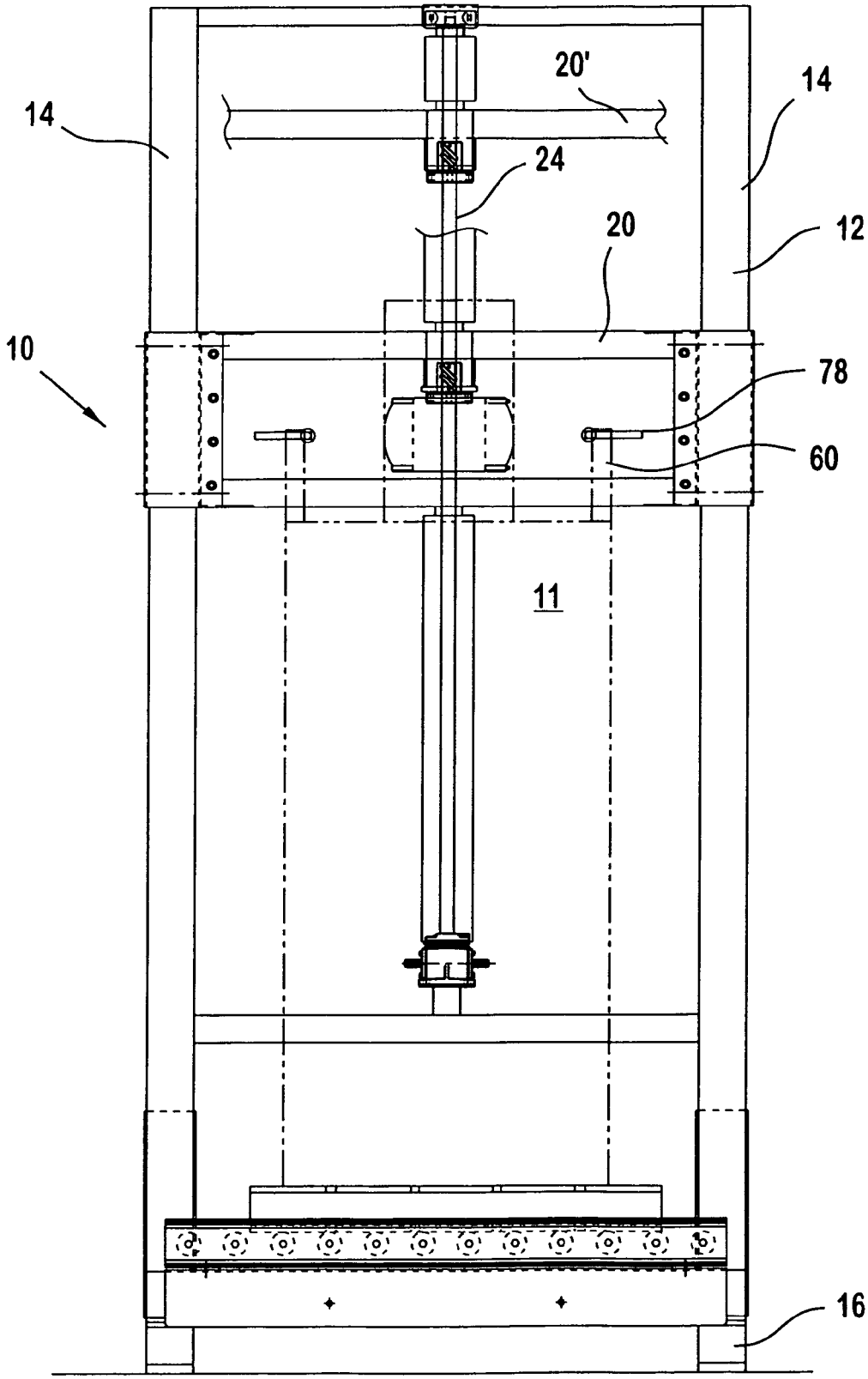

FIG. 16 is a front elevational view showing the bag filling head in an upper position for filling a large size bulk bag.

FIGS. 17A–17D are a series of views showing the bulk bag being attached to the bag filling head, the bag being returned to the bag filling position, the bag filling head being raised to a fill position and the bag inflated, and the filled bag being released.

DETAILED DESCRIPTION OF THE PREFERRED EMBODIMENTS

Certain terminology is used in the following description for convenience only and is not considered limiting. The words "right," "left," "lower" and "upper" designate directions in the drawings to which reference is made. This terminology includes the words specifically noted above, derivatives thereof and words of similar import. Additionally, the terms "a" and "one" are defined as including one or more of the referenced items unless specifically noted. The term "bag attaching position" in connection with the position of the moveable portion of the bag filling head for bag attachment refers to a position that can vary from true vertical to within about 35° of true vertical. A "side" of the bulk bag filler refers to any of the front, lateral and back areas of the bulk bag filler, as opposed to the top or bottom. In the drawings, the same elements are referred to with the same element numbers throughout.

Figure 1:
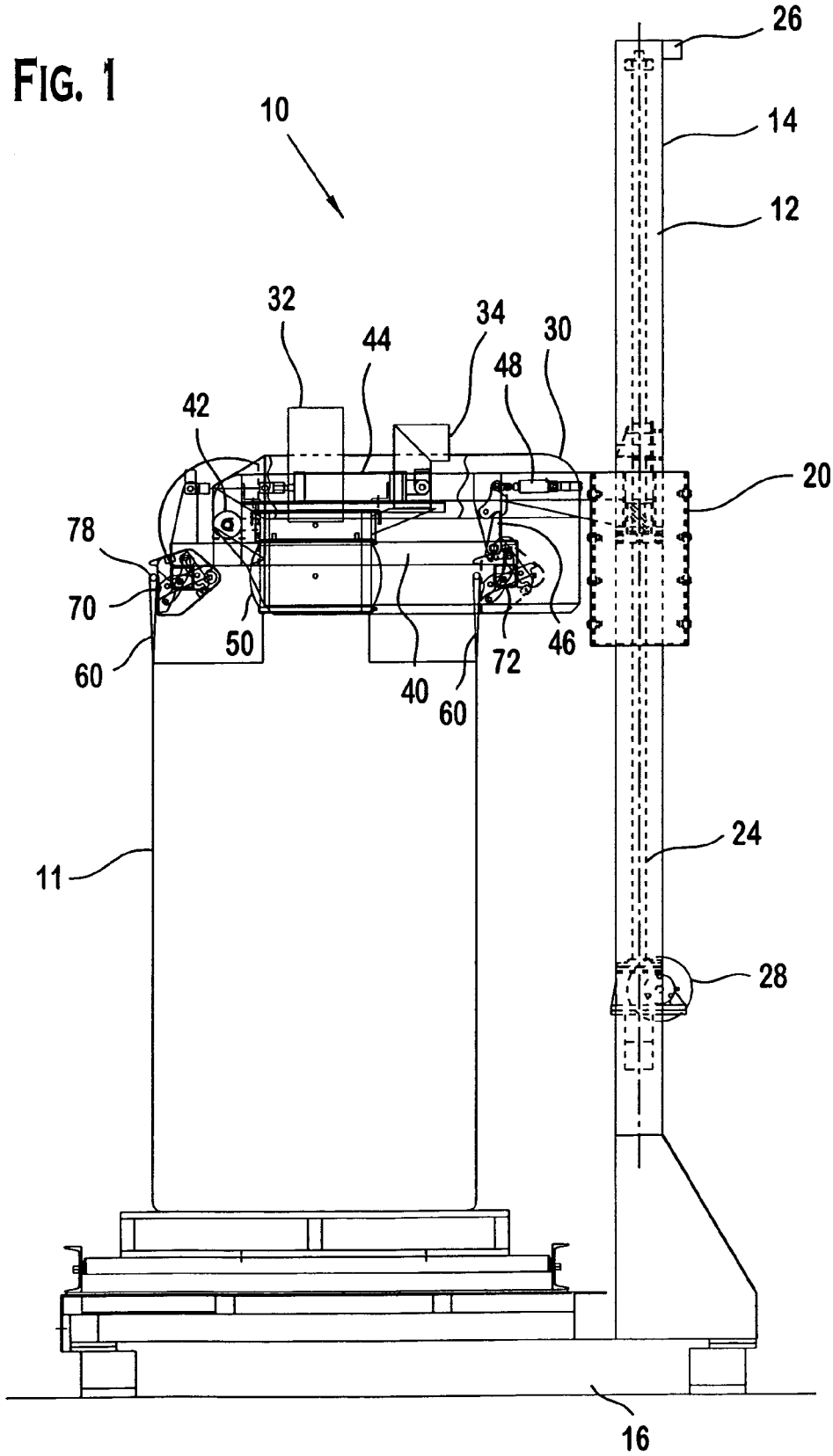
FIG. 1 is a side elevational view of a bulk bag filler in accordance with the present invention.
Figure 2:
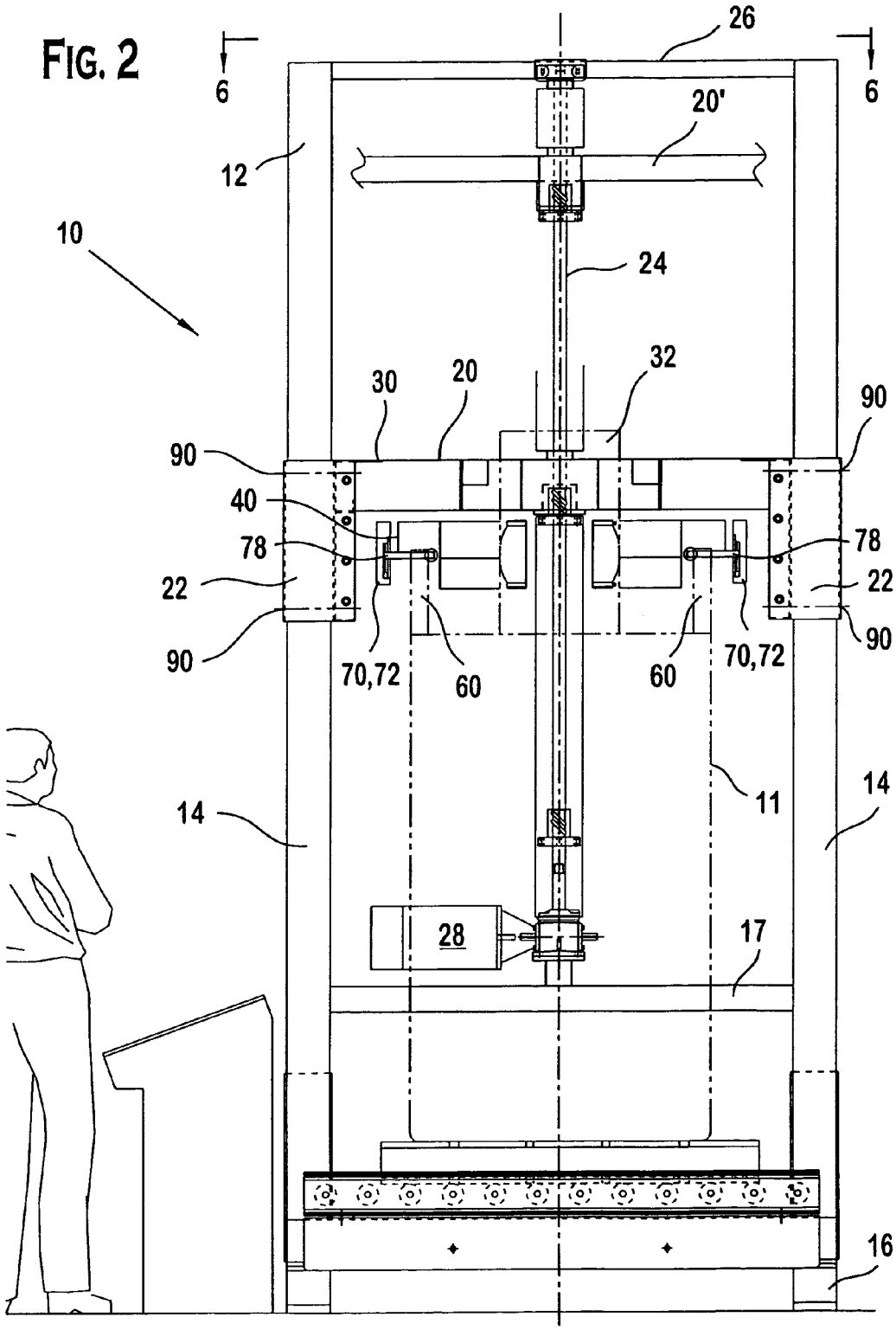
FIG. 2 is a front view of the bulk bag filler of FIG. 1.

Referring now to FIGS. 1 and 2, a bulk bag filler 10 in accordance with the present invention is shown. The bulk bag filler 10 includes a frame 12, having two generally vertically extending posts 14 mounted on a base 16. A bag support carriage 20 is connected to the posts 14 utilizing two trolley assemblies 22, which are described in further detail below. Lead screw 24 is mounted between a lower support 17 and a top cross piece 26 and engages the support carriage 20. A motor 28 is connected to drive the lead screw 24 and can be controlled by a controller to move the support carriage 20 up and down. The high position of the support carriage is indicated at 20' in FIG. 2.

Preferably the lead screw 24 is a ball screw which provides for higher speed and lower friction movement of the carriage 20. However, other vertical adjustment means, such as pneumatic actuators, a motor and drive belt, a manual crank or any other suitable actuator arrangement could be utilized. In a preferred embodiment, dust covering bellows (not shown) are attached over the lead screw to prevent the ingress of dust and other contaminants.

The trolley assemblies 22 each include at least two self aligning roller assemblies 90, and more preferably four self aligning roller assemblies 90, as shown in FIG. 6. The roller assemblies 90 include two half rollers 92 mounted on a sleeve 94. As shown in FIG. 6, the outer support 23 of the trolley can be slid inwardly and outwardly prior to being bolted into position so that the rollers 92 are located with their radius firmly against the outer radius of the posts 14. This arrangement allows the half rollers 92 to be positionally adjusted as needed to compensate for variations in tubing width, so that a smooth rolling fit without chatter or binding can be easily achieved. In the preferred embodiment, upper and lower half rollers 92 are provided on both the front and rear sides of the frame posts 14, so that each trolley 22 includes eight half rollers 92, which are mounted on four separate sleeves 94. While the roller assemblies 90 are preferred, other slide or anti-friction devices and self aligning rollers could be utilized.

Figure 3:
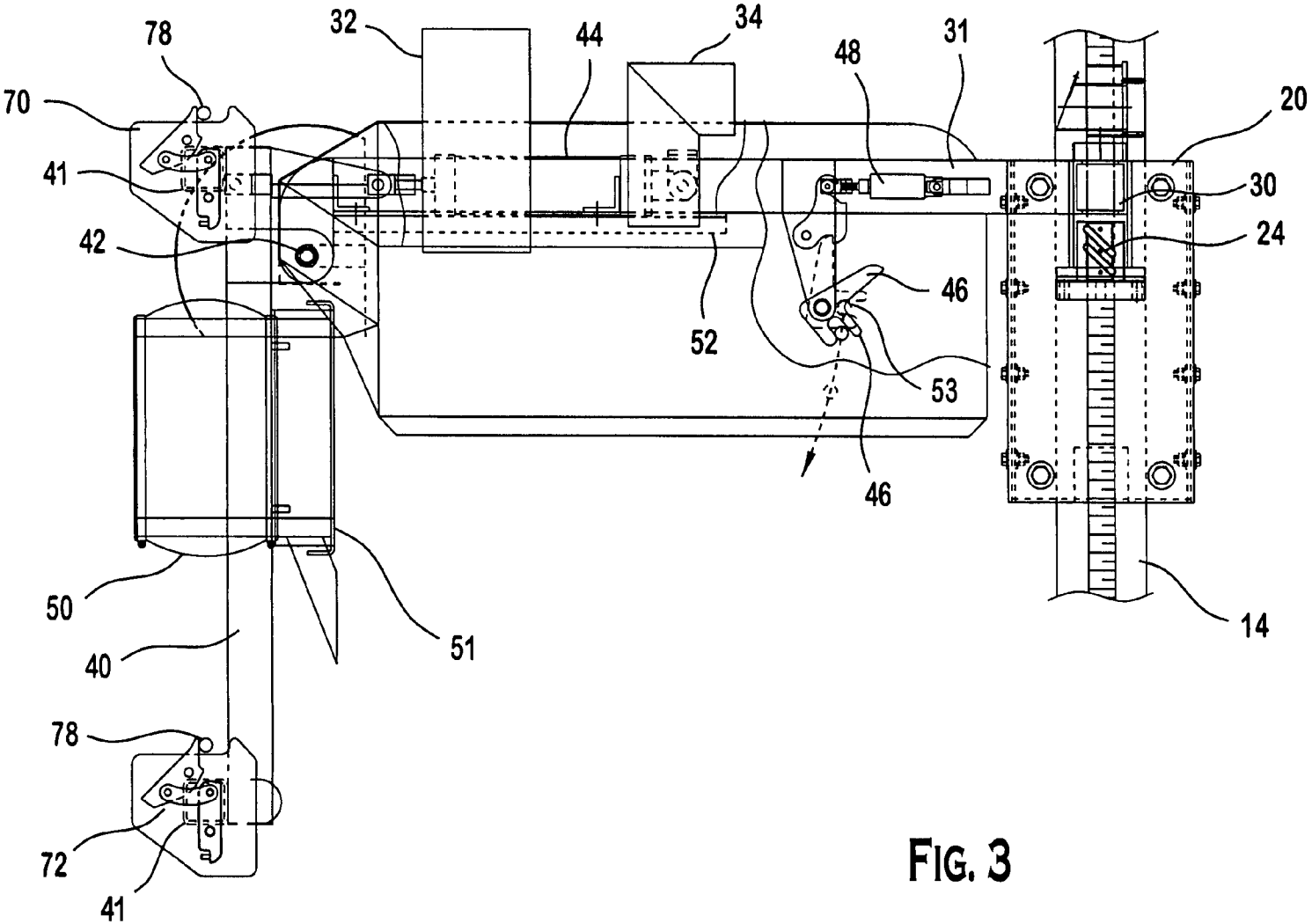
FIG. 3 is an enlarged side view of a the bag filling head shown with the fill head cover partially broken away and with the bag attachment portion repositioned down to a bag attaching position.
Figure 17A:
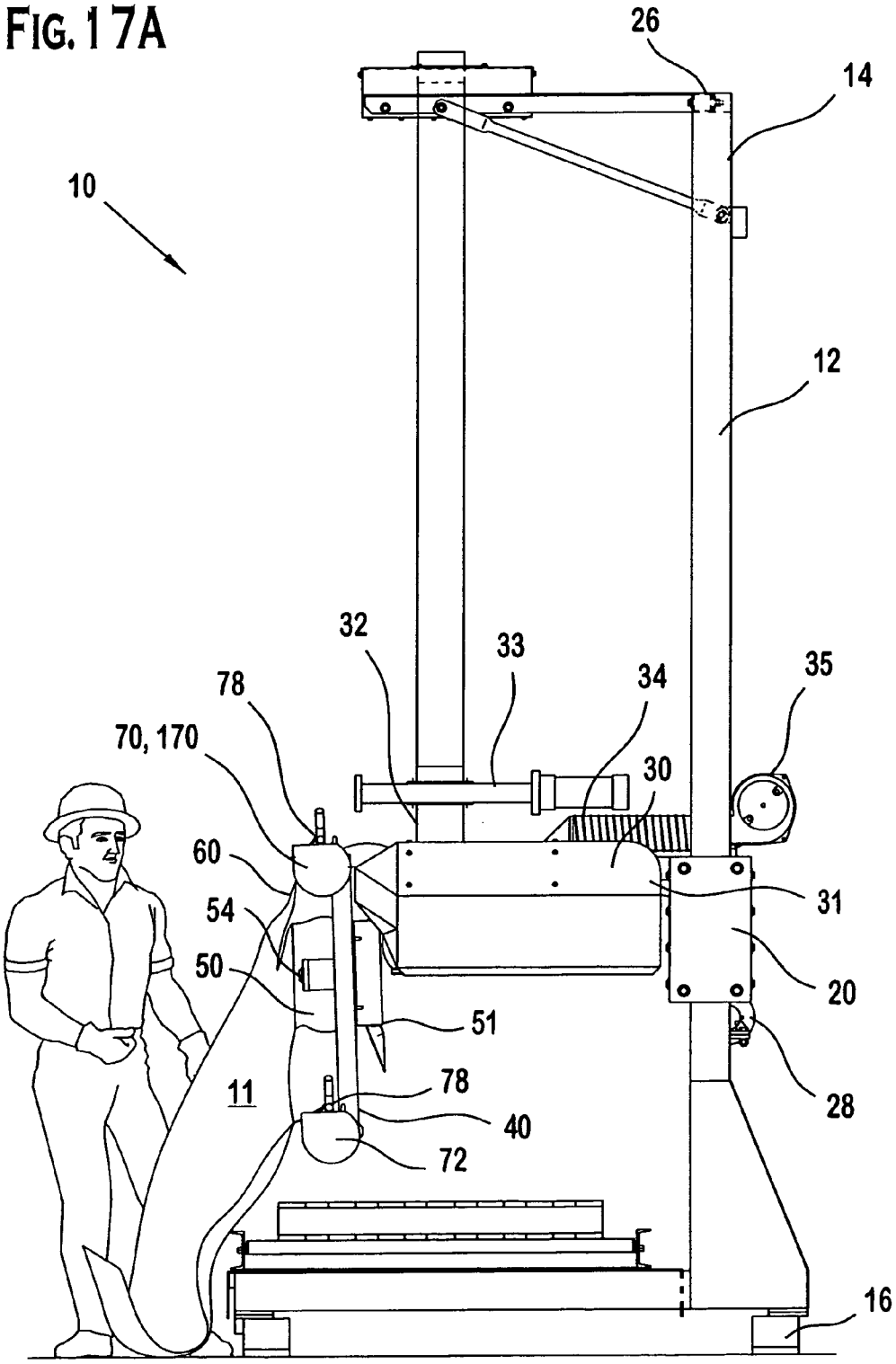

A bag fill head assembly 30 is connected to the bag support carriage 20. Preferably, a bulk material fill tube 32 is connected to the bag fill head 30. A gate valve 33, shown in FIG. 17A, may be used to control flow of bulk material to the fill tube 32. A bag inflation/vacuum port 34 is provided which allows for inflation of an empty bag prior to filling, as well as collection of displaced air and particulates which could otherwise be discharged to atmosphere as the bag is filled. This is preferably connected to a vacuum/blower 35, as shown in FIG. 17A. As is shown in detail in FIG. 3, the bag filling head assembly 30 includes a base portion 31 and a moveable head portion 40. The moveable head 40 includes bag hanging frames 41 on which the hanging loop supports 78 are mounted. The moveable portion 40 of the bag filling head 30 can be moved from a filling position, in which the bag hanging loops or straps 60 are suspended from hanging loop supports 78, pivotally mounted on the bag hanging frame 41, in a position to allow the bulk bag 11 to be filled (as shown in FIGS. 1 and 2), to a bag attaching position, in which the hanging loop supports 78 are moved to an operator access position in which the hanging loop supports 78 to attach a bulk bag 11 to be filled are moved to a position in proximity to a side of the bulk bag filler 10 (as shown in FIG. 3). Latch mechanisms 70, 72 are preferably connected to the bag hanging frame 41 to support and release the hanging loop supports 78, as explained in detail below. While a preferred arrangement is shown, various types of hanging loop support arrangements that are mechanically or hydraulically actuated to hold and/or release a bag hanging strap 60 can be utilized.

In the illustrated embodiment, repositioning of the moveable head 40 is carried out by a pivotal movement about the two pivots 42 towards the front of the bulk bag discharger 10 utilizing an actuator 44 mounted on the bag filling head 30. This is preferably accomplished by releasing safety latches 46 utilizing release actuators 48, as shown in FIG. 4. The actuator 44 is then used to power the moveable head 40 to the position shown in FIG. 3, in which hanging loop supports 78 and the associated front latch mechanisms 70 and rear latch mechanisms 72 are located in the bag attaching position near the front side of the bulk bag filler 10. In the present case, the latches 70, 72 generally define a plane that is within approximately thirty-five (35) degrees or less of true vertical. More preferably, this is within about fifteen (15) degrees of true vertical, and most preferably, the moveable head 40 positions latch mechanisms 70, 72 within about five (5) degrees of vertical to true vertical. However, depending upon the particular application and the size of the bags being filled, the angle could be greater up to about sixty (60) degrees from vertical. Additionally, while in the preferred embodiment the moveable head 40 pivots toward the front of the bulk bag filler 10, it is also possible that it could pivot toward either lateral side or the rear side, depending on the particular arrangement and application. Alternatively, repositioning movement could be carried out by other types of actuators to provide tilting and/or translational movement.

As shown in FIGS. 3 and 5, preferably an inflatable seal assembly 50 is provided for connecting the bag spout to the bulk material fill tube 32. Such inflatable connections are known in the art, and accordingly have not been described here in further detail. In the preferred embodiment, the seal assembly 50, including the inflatable seal, is connected to the moveable head assembly 40 and moves therewith to the operator access position to allow for easier connection of the bulk bag 11. The inflatable seal 50 includes a top flange 51, which seals against a gasket 52, shown in FIGS. 3 and 4, located on base portion 31 of the filling head assembly 30 in order to make a sealed connection with the material fill tube 32. A control 54 for the inflatable seal assembly 50 is preferably located on the moveable portion 40 of the bag filling head 30, as shown in FIG. 5. This allows easy access for an operator during installation of a new bulk bag 11.

Additionally, the connection to the bulk material fill tube 32 is preferably provided in a known typical arrangement with concentric tubes, as shown in FIGS. 3 and 5. The area between the tubes is utilized for blowing air into the bag via the duct 34 and blower/vacuum 35 for bag inflation, or for withdrawing displaced air from the bag as it is filled to minimize dust. The gasket 52 preferably provides a sealed, dust proof connection for both the material fill tube 32 as well as the inflation/vacuum port 34 to the flange 51. This is shown most clearly in FIGS. 4 and 5.

Referring again to FIG. 3, the moveable head release actuator 48 preferably holds the release catch 46 in a closed position. Preferably, two release actuators 48 are utilized to release two separate catches 46. In order to facilitate rotation of the moveable head 40 of the filling head assembly 30 downwardly, the moveable head release actuators 48 are energized. The actuator 44 is then actuated in order to drive the moveable head 40 to the bag attaching position as shown in FIG. 3 and in FIG. 17A. As the moveable head 40 moves downwardly from its generally horizontal bag filling position, safety catch bars 53 on the moveable head 40, shown most clearly in FIG. 5, pull the release catches 46 downwardly so that the moveable head 40 is released and the catches 46 are in a re-latching position. When the moveable head 40 is retracted via the actuator 44, it pushes the release catches 46 back up to the position where they are reengaged by the release actuators 48, which acts as a safety mechanism.

Referring now to FIGS. 7A–7E, a first preferred embodiment of the latch mechanisms 70, 72 is shown in detail. The latch mechanisms 70, 72 are generally the same with the left and right sides being opposite-handed arrangements of the latch mechanisms 70, 72.

Referring to FIG. 7A, the latch mechanisms 70, 72 include a support member 74, which is pivotally mounted to a frame member on the moveable head 40 at a first pivot point 103. The support member 74 has a first bag loop support arm contacting surface 76 at a first end thereof, which contacts the bag loop supports 78. The bag loop supports 78 are generally L-shaped and pivot about an axis 80, as shown in FIGS. 7A and 7B. A second end of the support member 74 is connected via a pivot link 82 to a first end 86 of a latch member 84. The latch member 84 is pivotally mounted at a second pivot point 105 on the frame member of the moveable head 40. A latch release pin 88 is connected to an actuator (not shown), which is movable from a first position, in which the latch release pin 88 extends under a second end of the latch member 84, to a second position, away from the latch member 84. Preferably, the latch release pin 88 is movable in a direction generally perpendicular to the latch member 84 and parallel to the axis of the pivots. In the position shown in FIG. 7A with the latch release pin in the first position, the latch member 84 is held in a latched horizontal position with the bag loop supports 78 being supported by the first end 76 of the support member 74.

As shown in FIG. 7B, with the latch release pin 88 in the second position, away from the latch member 84, in this case preferably drawn inwardly (into the plane of the paper in the views shown), the latch member 84 is free to pivot about its pivot point due to the weight of the bag strap 60 pulling downwardly on the bag loop supports 78, which contacts the first end 76 of the support member 74, driving the first end 76 of the support member 74 downwardly to release the bag loop supports 78, as well as the bag loop 60 located thereon. The bag loop 60 can slide off the end of the bag loop supports 78. As shown in FIG. 7B, the second end 77 of the support member 74 contacts the latch member 84 in order to prevent over-travel of the support member 74.

Referring now to FIG. 7C, once the bag loop support 78 drops past the support member 74, gravity acting on the support member 74, the pivot link 82 and the latch member 84 cause the first end 76 of the support member to pivot upwardly to a pre-reset position.

Referring to FIG. 7D, this shows the latch mechanism 70, 72 re-oriented after the moveable head 40 has pivoted to the bag attaching position, as shown in FIG. 3. In this position, gravity acting on the support member 74, pivot link 82 and latch member 84 causes the first end 76 of the support member 74 to move upwardly into a bag loop support 78 engaging position. An operator can place a bag strap 60 on the bag loop support 78 and pivot the bag loop supports 78 into a re-latching position, wherein it contacts the first end 76 of the support member 74 and causes it to pivot downwardly, allowing the bag loop support 78 to be moved to the relatched position as shown in FIG. 7E. At this point, once the bag spout is connected to the inflatable seal 50 of the material fill tube, the moveable head 40 can be returned to the bag filling position with a new bulk bag 11 ready to be filled.

A second preferred embodiment of the latch mechanism 170 is shown in FIGS. 8–13. While only the right hand version of the second embodiment of the latch mechanism 170 is shown, those skilled in the art would understand from the present disclosure that the left hand version for use on the left side of the moveable head portion 40 of the fill head assembly 30 would be a mirror image thereof. The latch mechanism 170 includes the support member 174 pivotably mounted to the frame member 201 at a first pivot point 203. The first end 176 supports the bag loop support 78. The second end 177 of the support member 174 directly contacts the latch member 184 which is also pivotably connected to the frame member 201 at a second pivot point 205. A counter-weight 189 is formed on the latch member 184 through an enlarged portion or an added weight. The latch release pin 188 is similar to the latch release pin 88 of the latch mechanisms 70, 72. The latch mechanism 170 does not require the connecting link as in the first embodiment of the latch mechanism 70, 72, and achieves the same functionality, with the second end 177 of the support member 174 pushing the latch member 184 upwardly when the latch release pin 188 is released, as shown in FIG. 9. Gravity acting on the counter-weight 189 and on the second end 177 of the support arm 174 results in the resetting and movement to the re-latching position as the latch mechanism 170 is re-oriented by movement of the bag moveable portion of filling head 40 to the bag attaching position, as shown in FIGS. 10 and 11.

In FIG. 12, a strap 60 from a new bag is placed over the bag loop support arm 78, and it is re-latched, as shown in FIG. 13, preferably by pushing the handle 181, preferably forward integrally with or offered to the support arm 78, toward the latched position, in the direction of stop 211. The support arm 174 pivots out of the way for bag loop support arm 78 to pass to the relatched position, and gravity then returns the support arm 174 to the relatched position. Upon the moveable portion of the bag filling head 40 being repositioned to the bag filling position, the bag loop support arm 78 is again supported via the second end 177 of the support arm 174 contacting the latch member 184, which is prevented from rotation via the latch release pin 188.

FIGS. 14–16 show views of the bulk bag filler 10 with the bag support carriage 20 located at different heights, depending upon the size of the bulk bag 11 being filled. This can be easily accomplished by an operator utilizing the moveable lead screw 24 or other vertical adjustment means for the bulk bag filler 10.

Figure 17B:
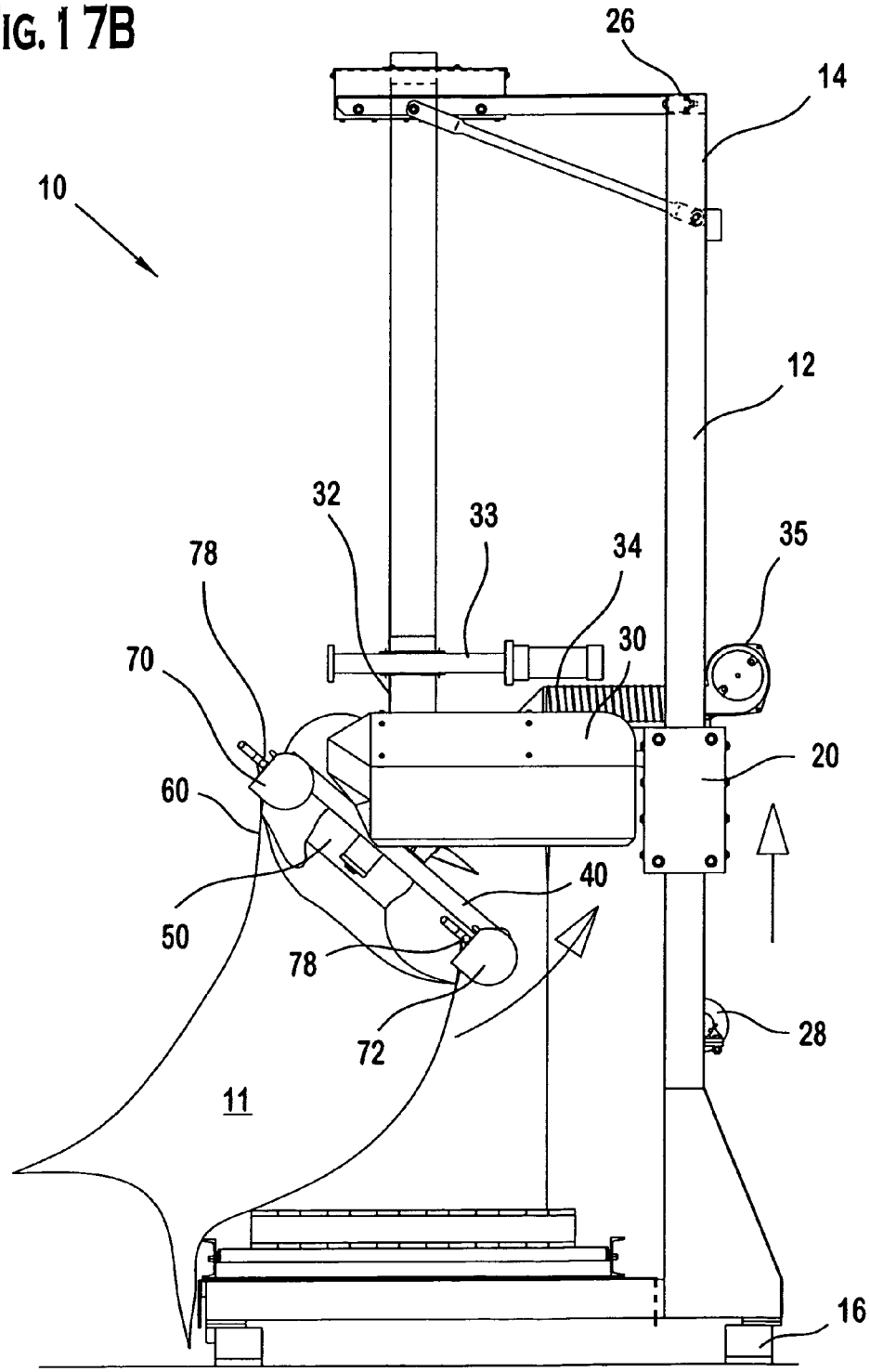
Figure 17C:
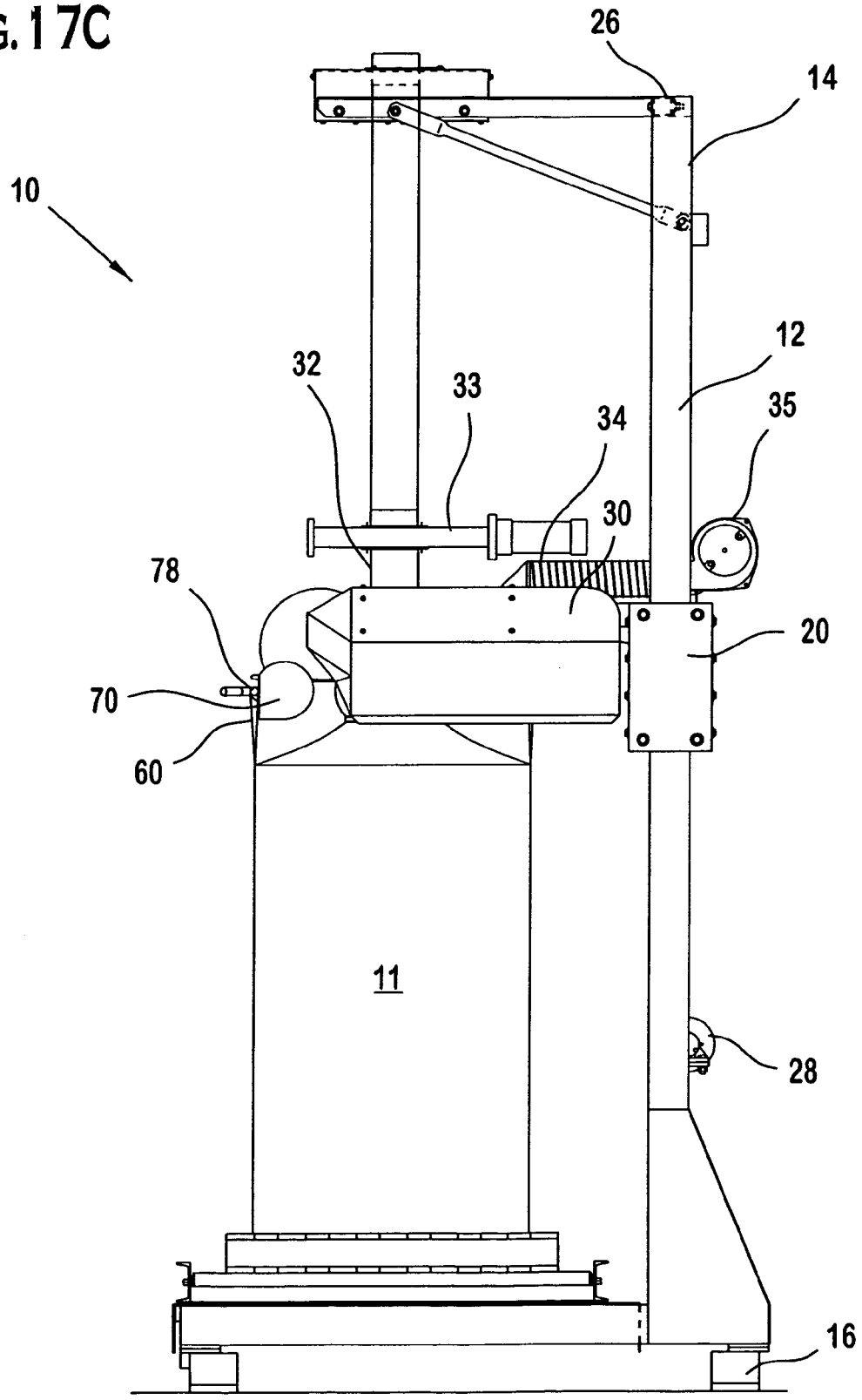

Referring to FIGS. 17A–17D, the bulk bag filler 10 is shown with the moveable head 40 in the bag attaching position. In FIG. 17A, an operator is shown after placing the tubular bag spout over the inflatable seal assembly 50, which is inflated using the control 54 on the moveable head 40. The bag straps 60 have been attached to the latches 70, 72, 170. In FIG. 17B, the moveable head 40 is shown returning to the bag filling position after the bulk bag 11 has been attached to the latch mechanisms 70, 72, or 170. In FIG. 17C, the bag support carriage 20 has been driven upwardly via the lead screw 24 to the proper height for the bulk bag 11 to be filled. Air can be blown in through the duct 34 by the vacuum/blower 35 in order to inflate the bag prior to filling.

Figure 17D:
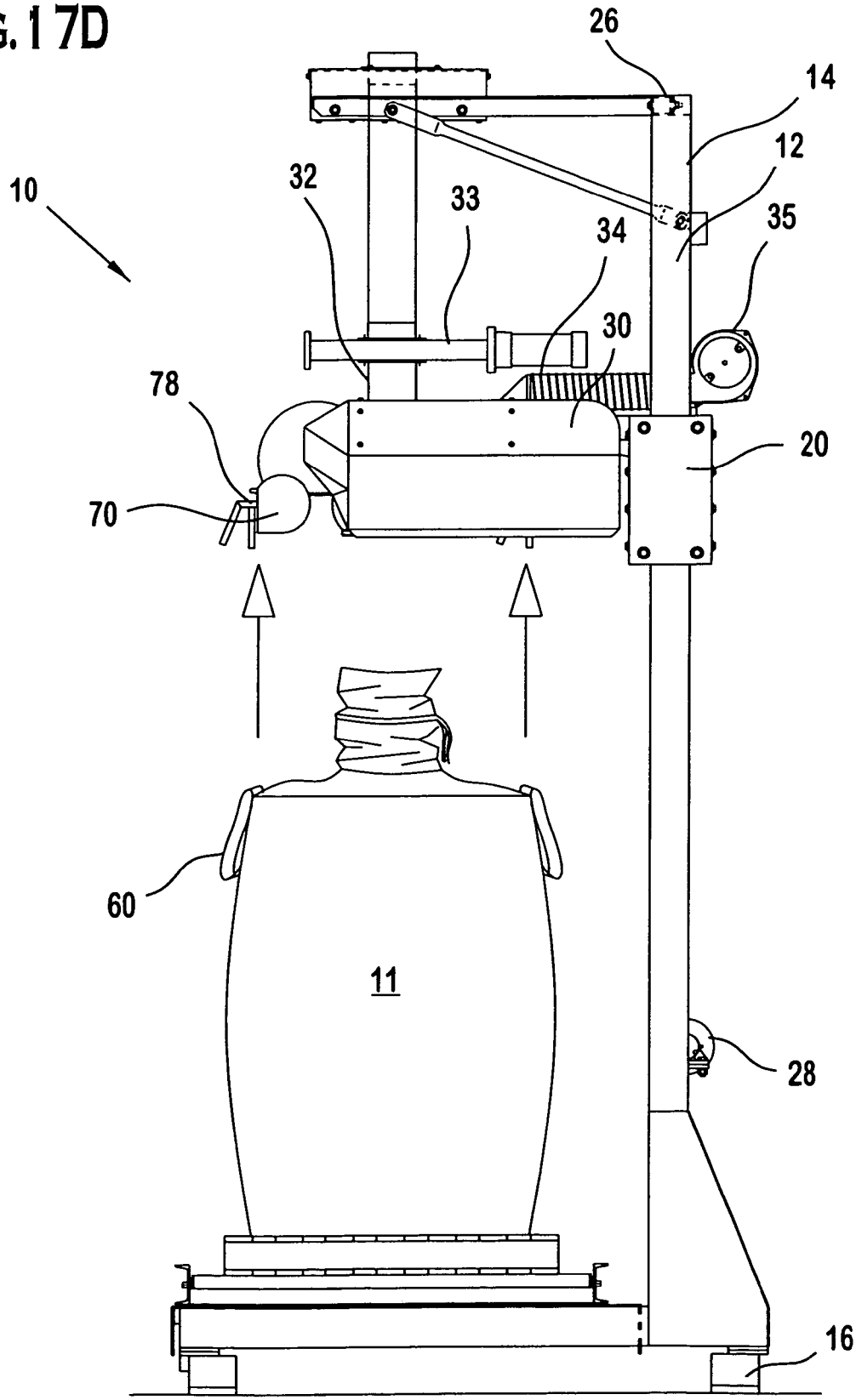

When a full bag is located on the bulk bag filler 10, the inflatable seal 50 which holds the bag spout is deflated, allowing the bag spout to be released from the fill tube connection. At the same time, the latch release pins 88 are moved to a release position, so that the support members 74, 174 of the latch mechanisms 70, 72, 170 are free to pivot. The controller signals the drive motor 28 to drive the lead screw 24 in a direction to move the bag support carriage 20 upwardly. As the bag support carriage 20 moves upwardly, as shown in FIG. 17D, the weight of the full bag 11 acting through the bag straps 60 pull downwardly on the bag loop supports 78, causing the support members 74, 174 to pivot to the open position, releasing the straps 60. With the support carriage 20 having moved the bag filling head 30 upwardly and out of the way, the filled bulk bag 11 can be removed using a forklift and/or via sliding it along a roller conveyor to a next position for further handling.

Once the filled bulk bag 11 has been moved out of the way, the bag support carriage 20 moves the bag filling head 30 downwardly. The moveable head 40 is preferably rotated about the pivot points 42, by enabling the release actuators 48 and utilizing the actuator 44. The movement of the moveable head 40 can be accomplished at the same time as the downward movement of the bag fill head assembly 30 or can be separate movements, depending upon the particular application. Once the moveable head 40 is at the proper bag attaching height and orientation, an operator connects the bag spout of a new bag 11 to be filled to the seal assembly 50 and attaches the four bag straps 60 onto the bag loop supports 78 and resets the bag loop supports 78, preferably by pushing the handles 181, such that the bag loop support 78 are engaged by the support members 74 of the latch mechanisms 70, 72 and 170, as shown in FIG. 17A. The process repeats, with the moveable head 40 being moved to the bag filling position via the actuator 44 and the release catches 46 being reengaged by the actuators 48, as shown in FIG. 17B. The lead screw 24 is driven via the drive motor 28 to move the bag filling head 30 to the proper height for the bulk bag 11 being filled.

In practice, it is preferred that a vacuum is drawn through the connection 34 in order to remove displaced air and dust from the bulk bag 11 as it is being filled. Alternatively, a dust filter can be provided to allow filtered displaced air to be vented to atmosphere.

Preferably, all of the movements of the fill head assembly 30, the moveable head 40, and the associated latches and actuators are controlled by a controller, for example as shown by the operator in FIG. 2, so that movements can be pre-programmed for particular applications, bags sizes, etc. This allows the fill head assembly 30 and the moveable head position 40 to be moved to a convenient position for an operator to attach a new bag and also allows the fill head assembly 30 to be moved upwardly to allow for easy removal of the filled bag prior to repositioning the fill head assembly 30 and the moveable head 40 to the bag attaching position. Various controllers, such as PLC's, can be used to control the bag filler 10.

It will be appreciated by those skilled in the art that changes can be made to the embodiment of the invention described above without departing from the broad inventive concept thereof. It is also understood that various portions of the invention can be used alone or in combination and that not all of the components are required for any particular application. It is therefore understood that this invention is not limited to the particular embodiment disclosed, but is intended to cover modifications within the spirit and scope of the present invention.

What is claimed is:

1. A bulk bag filler for filling bulk bags having bag hanging loops and a fill spout, the filler comprising:

a bag filling head including a base portion and a moveable portion that is moveable from a bag filling position, in which the hanging loops are suspended from hanging loop supports located in a generally horizontal plane to allow the bulk bag to be suspended in a generally upright vertical position for filling, to a bag attaching position, in which the hanging loop supports are located in a second plane angled from the first plane for attachment of a bulk bag.

2. The bulk bag filler of claim 1, wherein the bag filling head is mounted to at least one support carriage for up and down movement.

3. The bulk bag filler of claim 2, further comprising an actuator for up and down movement of the bag filling head.

4. The bulk bag filler of claim 3, wherein the actuator is a powered lilting device.

5. The bulk bag filler of claim 2, further comprising a frame with two vertically extending posts, the at least one support carriage comprises two support carriages, one of the support carriages being connected to each of the posts for up and down movement of the bag filling head.

6. The bulk bag filler of claim 1, wherein the moveable portion of the bulk bag filling head is mounted for pivoting movement about a generally horizontal axis on the base portion of the bag filling head.

7. The bulk bag filler of claim 1, wherein the moveable portion is pivotable to a position in proximity to a front side of the bag filler.

8. The bulk bag filler of claim 1, further comprising an actuator mounted between the moveable portion and the base portion of the bag filling head for movement of the moveable portion of the bag filling head between bag filling position and bag attaching position.

9. The bulk bag filler of claim 1, further comprising a bulk material fill tube connection located on an upper part of bag filling head.

10. The bulk bag filler of claim 9, further comprising a sealed connector assembly for the bag fill spout located on the moveable portion of the bag filling head, and a gasket located on the base portion of the bag filling head to provide a sealed connection between the bulk material fill tube and the sealed connector assembly when the moveable portion is in the bag filling position.

11. The bulk bag filler of claim 10, further comprising a control for the sealed connector assembly located on the moveable portion of the bag filling head.

12. The bulk bag filler of claim 1, further comprising at least one tilt release actuator located on the bag filling head to unlock the moveable portion of the bag filling head for movement to the bag attaching position.

13. The bulk bag filler of claim 1, further comprising a controller to control movement of the moveable portion of bag filling head and for controlling up and down movement of the bag filling head.

14. The bulk bag filler of claim 1, wherein the moveable portion comprises a bag hanging frame on which the hanging loop supports and respective latch mechanisms are mounted.

15. The bulk bag filler of claim 14, wherein the bag hanging frame is pivotable from the bag filling head about at least one pivot axis located along a side of the bulk bag filler.

16. A bulk bag filler for filling bulk bags having bag hanging loops and a fill spout, the filler comprising:

a bag filling head including a base portion and a moveable portion that is moveable from a bag filling position, in which the hanging loops are suspended from hanging loop supports in a position to allow the bulk bag to be filled, to a bag attaching position, in which at least some of the hanging loop supports for attachment of a bulk bag to be filled and a bag spout connection are positioned in proximity to a side of the bag filler.

wherein the hanging loop supports have at least one associated latching mechanism comprising:

a support member, pivotally mounted to a latch frame at a first pivot position, and having a first bag loop support contacting surface at a first end thereof and, at a second end thereof, contact a first end of a latch member that is pivotably mounted at a second pivot position, a latch pin connected to an actuator which is moveable from a first position, in which it extends under a second end of the latch member, to a second position, away from the latch member, upon the latch pin being moved to the second position, the first end of the support member being pivotable downwardly to release the bag loop support, and upon the bag loop support no longer contacting the support member, the support member being weighted so that the first end pivots upwardly to a reset position upon the latching mechanism being re-oriented to the bag attaching position in which the first end of the support member is in a bag loop support engaging position, so that the bag loop support can be pivoted into a re-latched position by causing the support member to pivot out of the way as the support arm is reset, and the support member is biased by gravity so that the first end returns to the re-latched position after the bag loop support is in the re-latched position.

17. A method of loading a bulk bag having hanging loops and a fill spout, comprising:

providing a bulk bag filler having a bag filling head with a base portion and at least a moveable portion with a bag fill spout connection, the movable portion being movable from a bag filling position, in which the hanging loops are suspended from hanging loop supports located in a generally horizontal plane to allow the bulk bag to be suspended in a generally upright vertical position for filling, to a bag attaching position, in which the hanging loop supports are located in a second plane angled from the first plane for attachment of a bulk bag;

moving the moveable portion of the bag filling head to the bag attaching position;

attaching the bag hanging loops to the hanging loop supports located in the second plane;

attaching the bag fill spout to the bag fill spout connection;

moving the moveable portion of the bag filling head to the filling position; and discharging material into the bulk bag through the bag fill spout.

18. The method of claim 17, further comprising:

adjusting a height of the bag filling head to a desired position based on a size of the bulk bag being filled.

19. The method of claim 17, further comprising:

adjusting a height of the bag filling head to a desired position for attaching the bag hanging loops and the bag spout.

20. The method of claim 17, wherein the moving of the moveable portion of the bag filling head to the bag attaching position further comprises tilting the moveable portion of the bag filling head to a position in which the hanging loop supports are located in the second plane which is angled within thirty-five (35) degrees of vertical.

21. The bulk bag filler of claim 1, wherein the second plane is angled from the first plane by at least approximately fifty-five (55) degrees, whereby the second plane is located within approximately thirty-five (35) degrees of true vertical.

* * * * *

UNITED STATES PATENT AND TRADEMARK OFFICE

CERTIFICATE OF CORRECTION

PATENT NO. : 7,004,212 B2
APPLICATION NO. : 11/098277
DATED : February 28, 2006
INVENTOR(S) : David R. Gill et al.

It is certified that error appears in the above-identified patent and that said Letters Patent is hereby corrected as shown below:

Col. 1, line 55, between “reach each” and “the”, insert --of--.

Col. 2, line 23, delete “a”.

In claim 4, Col. 8, line 35, delete “lilting” and insert therefor --lifting--.

In claim 16, Col. 9, line 24, after “filler”, delete the period (“.”) and insert therefor a comma (--,--).

Signed and Sealed this

Tenth Day of April, 2007

JON W. DUDAS
*Director of the United States Patent and Trademark Office*